United States Patent [19]

Harris et al.

[11] 3,968,274

[45] July 6, 1976

[54] TEXTURAL PANEL

[75] Inventors: David Andrew Harris, Bedminster, N.J.; Bruce Edward Hart, Milton, Pa.

[73] Assignee: Johns-Manville Corporation, Denver, Colo.

[22] Filed: Nov. 24, 1972

[21] Appl. No.: 309,302

Related U.S. Application Data

[62] Division of Ser. No. 142,705, May 12, 1971, Pat. No. 3,726,056.

[52] U.S. Cl. ..... 427/203; 181/33 GA; 427/264; 427/270; 427/276

[51] Int. Cl.[2] ..... B05D 1/36; B05D 5/00; E04B 1/99

[58] Field of Search ..... 117/9, 26, 28; 52/144, 52/316, 483, 506, 315; 181/33 R, 33 G, 33 GA; 427/264, 270, 203, 276, 52, 181

[56] References Cited

UNITED STATES PATENTS

| | | | |
|---|---|---|---|
| 1,318,096 | 10/1919 | McKay | 117/9 |
| 1,542,475 | 6/1925 | Ruess | 117/9 X |
| 1,913,666 | 6/1933 | Harshberger | 117/28 X |
| 1,972,810 | 9/1934 | Wettlaufer | 117/9 |
| 2,009,966 | 7/1935 | Allen | 117/9 |
| 2,018,216 | 10/1935 | McLean | 117/9 |
| 2,151,220 | 3/1939 | Mattes | 117/9 |
| 2,164,725 | 7/1939 | Snyder | 117/9 X |
| 2,214,387 | 9/1940 | Snyder | 117/9 X |
| 2,250,482 | 7/1941 | Harshberger | 117/9 |
| 2,270,809 | 1/1942 | Kaye | 117/9 X |
| 2,931,736 | 4/1960 | Park | 181/33 GA |
| 2,995,198 | 8/1961 | Green | 181/33 G |
| 3,077,945 | 2/1963 | Thomas et al. | 181/33 G |
| 3,086,878 | 4/1963 | Luaring | 117/8 |
| 3,097,080 | 7/1963 | Weir | 117/9 X |
| 3,151,700 | 10/1964 | Feild | 181/33 GA |
| 3,207,617 | 9/1965 | Baker | 117/9 |
| 3,357,516 | 12/1967 | Cadotte et al. | 181/33 R |
| 3,509,671 | 5/1970 | Akerson | 181/33 G |
| 3,666,521 | 5/1972 | Weyna et al. | 117/26 X |
| 3,749,629 | 7/1973 | Andrews et al. | 117/26 |
| 3,755,238 | 8/1973 | Wiita | 52/144 |

*Primary Examiner*—Michael R. Lusignan
*Assistant Examiner*—Stuart D. Frenkel
*Attorney, Agent, or Firm*—Robert M. Krone; Joseph J. Kelly; Stephen C. Shear

[57] ABSTRACT

A process of forming a visible textural surface on a decorative acoustical panel having a fibrous body portion is disclosed herein. This process includes coating an exterior surface of the body with a film of hardening liquid, distributing individual granules of particulate material generally uniformly over a substantial portion of the exterior surface to provide a granular texture to the surface, and coating the granules with a film of hardening liquid, which film is insufficient to eliminate the granular texture but which adheres the granules to the exterior surface. Thereafter a part of the surface on which the liquid coated granules are located is indented. These indentations extend from the exterior surface and penetrate partway into the panel body to cause the displacement of part of the surface, thereby forming wall portions. These wall portions include some of the granules.

1 Claim, 11 Drawing Figures

10
14
14
42

60
58
20
42
10
56
54
14
58
52
12
56
14
10
46
16
16

5
5
14

48
14
15
48
18
22
24
16
42
10
50
20
26
12

20
36
36
20
40
34
38
34

22
20
34
32
30
32
30

14
62
42
14
14
14
16
42
16
14
14
16
14
14
14
16

TEXTURAL PANEL

This is a division of application Ser. No. 142,705 filed May 12, 1971, which has matured into U.S. Pat. No. 3,726,056.

BACKGROUND OF THE INVENTION

1. Field of the Invention

This invention relates to the manufacture and securing of building members to a supporting structure. Members of the type upon which this invention has improved are fibrous, decorative panels mechanically punctured to provide a plurality of recesses or fissures extending inwardly from the exposed faces and part way through the panels to enhance the appearance of the exterior structure. Although the invention will be specifically described in connection with perforated panels comprising wood or mineral wool fibers, it may also be employed with other panels or members of vegetable, mineral, or synthetic fibers.

2. Description of the Prior Art

One of the major problems encountered in the manufacture of prefabricated structures is the difficulty of rapidly securing fibrous panels to joists, bridgings, and other supporting members. Decorative panels provided with a plurality of recesses or fissures, though frequently employed in the construction of prefabricated structures such as mobile homes and the like, have been found to be in need of improvement in this regard because the standard size sheets in which they are economically produced must be stocked in large quantities and size assortments, and applied in a customized manner in order to accommodate the wide variety of joist spacings required by different building codes, ceiling fixture placements, and humidity variations between bedrooms and baths or kitchens, for example. Appearance and durability can be sacrificed and considerable costs incurred when installing such panels on the flanges of exposed metal grid suspension systems, oftentimes requiring an elaborate arrangement of main carriers, interlocking cross-tees, thin, resilient, closed cell gaskets and hold-down clips, or in securing the panels to a supporting structure by cementing or by mechanical fasteners such as nails or screws. A tendency of cementitious material to "relax" its grip has frequently caused cemented ceiling panels to become loosened and drop out of alignment or fall completely from the ceiling. Unattractive "break-ups" in the pattern of a decorative panel are created by nails, screws or surface mounted rosettes which are visually apparent and not concealed within the textural surface of the panel. The difficulty of driving or screwing mechanical fasteners into holding contact with the bottom of fissures adjacent the corners of ceiling panels at economical speeds and without damaging their relatively soft and readily destructible ornamental textured surface will be immediately apparent. Appropriate precautions are currently required to prevent creation of panel surface blemishes during production of prefabricated building modules within environments conducive to smudging or contamination. Such building considerations have at times resulted in lower production rates than it was considered desirable to attain for commercial operations.

The design of ceiling tiles textured as above should be compatible with consumer preferences which have tended to reject monotonous, flat, painted ceiling panels in favor of monolithic fissure-textured surfaces unbroken by the flanges of exposed metal grids or surface mounted fastening devices. While office buildings and public facilities frequently contain ceiling tiles with darkened profiles revealed by sharp lines of cleavage of the side walls of fissures produced therein by fluid or mechanically operated punch-type means, the achievement of an aesthetic effect restfully pleasing to the eye often requires that fissured textures for interior home use be somewhat softer in appearance. It would additionally be desirable if the aesthetic effect produced by the fissuring arrangement permitted more rapid installation rates with minimum risk of injury to the panels. A discontinuous panel surface in which fissures formed by routing, etching, dye-stamping, lug punching, or the like, are sufficiently shaped to be compatible with the above noted contemporary aesthetic and economic requirements, though long sought has ere now not been discovered.

The instant invention has for its principal object the provision of an improved pre-finished panel wherein a decorative surface textured by indentations not only results in an aesthetic effect restfully pleasing to the eye, but eliminates the appearance of unattractive surface mounted fasteners, cracks, and nail pops. In addition, an object of the invention is to provide a method for mechanically fastening such a panel to a supporting structure in far shorter time, with greater ease, and at less expense than previously possible, to effect a plurality of omnidirectional indentations among which similar indentations are randomly produced when securing the panel to a supporting structure.

A further object of the present invention resides in a method for disrupting the surface of a fibrous board coated with mineral or synthetic granules by placing irregularly shaped elongated openings therein which resemble additional openings produced on the surface when securing the panel to a supporting structure.

A still further object of this invention is to furnish a scuff and impact withstanding panel of improved flame spread resistance which has a rough textural surface capable of rendering unobvious an additional surface roughening produced when securing the panel to a supporting structure.

Still another object of the invention is to devise a method whereby portions of material at the bottom of low areas produced in the panel surface as the result of securing the panel to a structural member have a color sufficiently similar to material located on the higher areas of the panel surface, that the panel appears to be relatively less textured when viewed from an angle at a distance.

SUMMARY OF THE INVENTION

To accomplish the stated objects, my novel panel is coated with granular particulate material which is held in place by a film of hardened liquid and provided with a plurality of recesses or indentations so that part of the surface on which the liquid coated granules are located forms portions of walls defining the indentations in the exterior surface of the panel. The textural surface thereby furnished permits the panel to be secured to a wide variety of supporting structures by power driven mechanical fasteners having crowns colored to match the relatively higher portions of the exterior surface of the panel. A unique means is thereby furnished for generating a stronger bond between such panels and a supporting structure in far shorter time, with greater ease, and at less expense than previously possible, while masking the appearance of mechanical fasteners driven to firm holding contact with material at the bottom of indentations effected by their entry.

Significant structural features are incorporated into the elements of my novel invention, whereby the provision of indentations in an exterior surface of the panel on which the liquid coated granules are located affords such excellent scuff and impact resistance that the panel remains untarnished when walked on during industrial ceiling construction and installation. As mechanical fasteners become lost among textured high and low portions of the panel which can appear to be relatively less textured when viewed from an angle at a distance, a low cost fire-resistant surface is created which permits rapid erection with a minimum risk of injury to the panels.

Additional objects and advantages will in part be obvious and will in part appear hereinafter.

BRIEF DESCRIPTION OF THE DRAWINGS

For a fuller understanding of the nature and objects of the invention, reference should be had to the following detailed description taken in conjunction with the accompanying drawings wherein.

DESCRIPTION OF THE PREFERRED EMBODIMENTS

Figures 1, 2, 3, 4, 5, 6, 7, 8, 9, 10, 11:
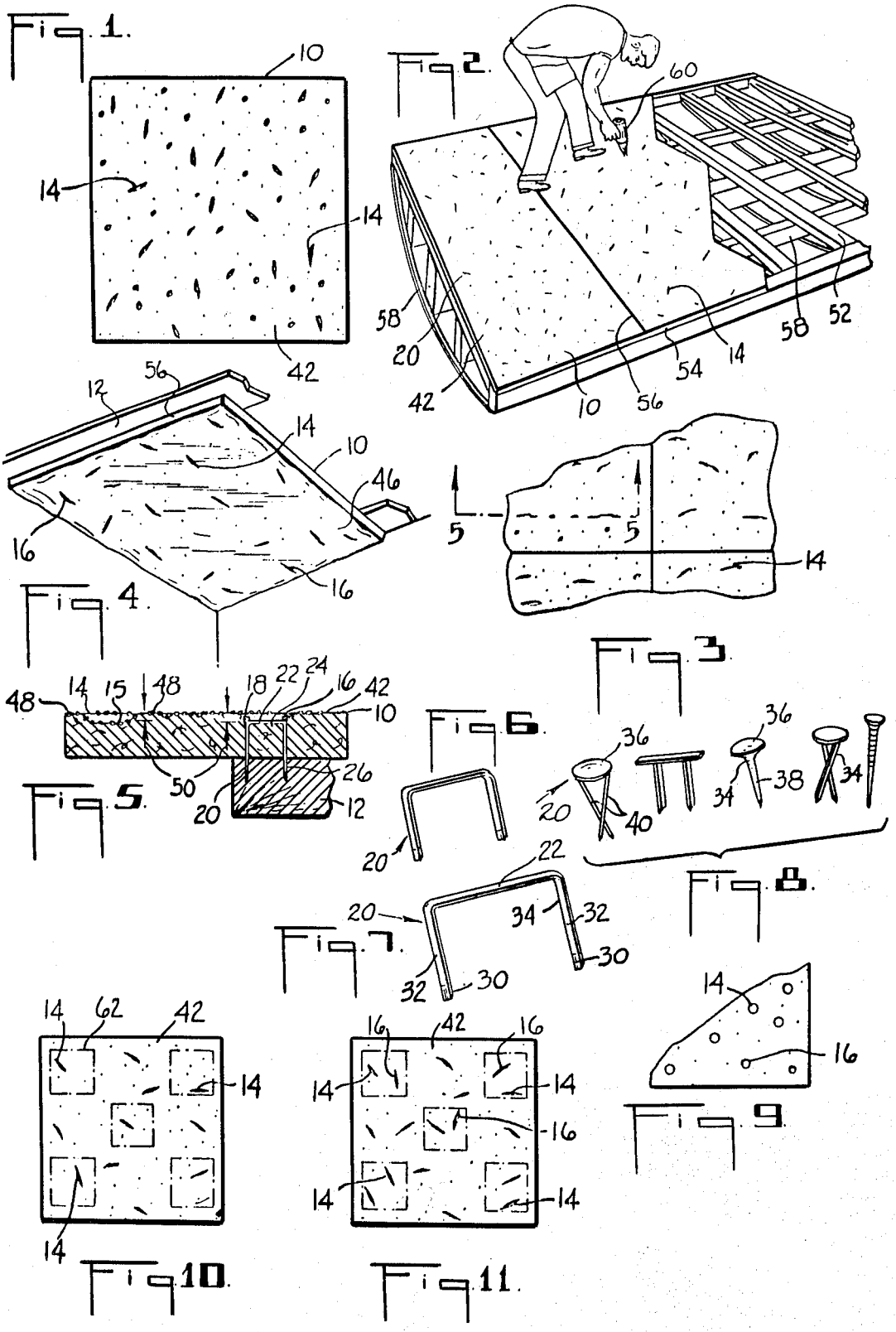
FIG. 1 is a top plan view depicting the textured front face of an embodiment of the present invention.
FIG. 2 is a perspective view of the panel of FIG. 1 secured to a supporting structure by a method of the instant invention.
FIG. 3 is a fragmentary plan view of applied panels incorporating in alternate embodiment of the invention.
FIG. 4 is a perspective view of a panel adapted for use in the invention pictured in FIG. 3, showing its structure in more detail.
FIG. 5 is a cross-sectional side view taken along the line 5—5 of FIG. 3.
FIG. 6 is a perspective view of a fastener employed in the instant invention.
FIGS. 7 and 8 are perspective views similar to FIG. 6, illustrating additional modified fasteners.
FIG. 9 is a fragmentary plan view of a panel adapted for use in another modification of the invention.
FIG. 10 is a plan view showing the panel of FIG. 1, the dotted portions depicting random areas appointed for entry of the mechanical fasteners of FIGS. 6, 7, and 8.
FIG. 11 is a plan view which depicts the subject matter of FIG. 10 showing, however, the original identations and their relation to additional indentations produced in the panel surface by entry of the mechanical fasteners.

The fissured granular surface of the present invention may be constructed in a number of relatively simple configurations. As a consequence the invention will be found to function with most varieties of granular textured surfaces. For the present illustrative purposes, the invention is described in connection with a textured panel of the ceiling tile variety. To facilitate the discussion to follow, the component parts of this apparatus which remain identical throughout the figures are provided with the same numeration.

Referring more particularly to the drawings, FIG. 2 depicts a textured panel 10 secured to joists 52 or other fastener receiving, supporting medium. Extending inwardly from the exposed face to predetermined depths of the panel are a plurality of sound entry recesses or indentations 14, shown in FIG. 5 having low surface areas 15 and higher areas 18 somewhat softer in appearance than those conventionally formed in mineral fiber board panels to permit entry of airborne sound to the relatively porous, interior structure. These indentations can be fabricated to permit an effectuation of similar indentations 16 having higher areas 18 by randomly impelling fasteners 20 sufficiently through panel 10 that the top surface of crown 22 is located the same depth from area 18 as is area 15, while anchoring means 26 of fastener 20 extends through an unperforated thickness of the panel and into furring strip 12 or other fastener receiving, supporting medium. With more board material interposed between crown 22 of fastener 20 and furring strip 12 than if fastener 20 were inserted into a pre-existing fissure, an increased holding power is provided which not only allows an installation of fastener concealed panels thinner than heretofore applied, but facilitates more rapid erection of textural panels with minimum risk of injury to the surface thereof.

Referring to FIGS. 6 and 7, mechanical fasteners 20 are revealed in more detail. Although the configuration of fastener 20 may be modified to function with a variety of surface contours, impressions, or indentations, it is generally preferred that the surface indentations or openings fashioned by entry of crowns 22 dimensionally correspond with the respective lengths and widths, diameters, or major and minor axes of a sufficient number of openings formed by indentations 14 that crowns 22 are obscured by textured high and low surface portions on the panel's exterior surface. In one embodiment of the invention, pointed forward ends 30 of shanks 32 connected to crown 22 intermediate and relatively adjacent rear ends 34 of shanks 32 are directed into panel 10 with sufficient force to implant crown 22 inward from the exposed face a similar distance from area 18 as is area 15. FIG. 6 illustrates a type of fastener particularly adapted to be driven into wooden furring strips or other supports while the elongated fastener of FIG. 7 or an oval crown 36 shown in FIG. 8 with a single shank 38 or plural divisible diverging shanks 40 is applicable where the supporting structure comprises a less dense material such as gypsum board. The crowns 22 of fasteners 20 may be painted before entering textured surface 42 to achieve a firm contact with areas 24 at the bottom of indentations 16. The crowns 22 should preferably be located at substantially the same depth from areas 18 on the outer surface of the panel as the bottoms 15 of indentations 14. Such location of crowns 22 tends to provide indentations 16 with the same depth dimension as indentations 14 and helps to make indentations 16 very similar in appearance to indentations 14. The depth 50 of indentations 16 need not be the same as the depth 50 of every indentation 14. As long as a substantial number of indentations 14 have a depth similar to the depth of indentations 16, the crowns 22 of mechanical fasteners 20 will not be visually apparent. It will be apparent that depending upon the type of texture material employed and the aesthetic effect desired, the depth 50 of indentations 16 may be varied in relation to the depth of indentations 14 in order to produce the requisite resemblance between indentations 14 and 16. In another embodiment of the invention, shown at FIG. 4, crowns 22 are provided with colorations similar to the color of areas 18 before contact with areas 24 at the bottom of indentations 16. Surface 46 is fashioned into a pluraltiy of high and low portions which resemble additional high and low portions produced by entry of mechanical fasteners 20 when securing the panel to a supporting structure. The similar coloration extant between portions of material at the bottom of lower areas of the panel surface and material on the higher areas 18 of the panel permits the panel to appear to be relatively less textured when viewed from an angle at a distance.

In effecting the resemblance between indentations 14 and 16, it is desirable to employ a granular particulate material such as coating granules 48 generally uniformly distributed over a substantial portion of the panel surface. Such granules 48 can be adhered to the exterior surface of the panel by a film of hardening liquid such as white primer paint. An embossing plate is then brought into engagement with the panel surface to shear artificial openings or indentations 14 into the panel extending from the exterior surface and penetrating substantially into the body of the unit. During creation of the artificial openings or indentations 14, part of the surface on which the liquid coated granules are located will be displaced into openings to form portions of walls defining indentations 14. Fasteners 20 entering the exterior surface to secure panel 10 to a supporting structure create additional indentations 16 which bear a surprising resemblance to indentations 14. Preferably, for elongated fasteners having rectangular shaped crowns, the diameter of granule 48 and the depth 50 of indentations 14 or 16 should be approximately the same.

In the embodiments thus far described, it was desired to secure the decorative panel by power driven mechanical fasteners having crowns 22 colored to match relatively high areas 18 on the exterior panel surface. Inasmuch as the visual characteristics or aesthetic effects achieved by decorative panels vary considerably, it may sometimes be necessary to secure various panel materials, sizes and shapes with liquid coated granules adhered to an exterior surface in a number of textural forms. Certain alterations to the above decorative panel will permit its functioning within the scope of the invention to achieve for countless configurations of granular textured surfaces sufficient similarity of appearance between indentations 14 and 16 to render unobvious an additional surface roughening produced when securing the panel to a supporting structure. Such modifications are intended to fall within the spirit and scope of the present invention as defined by the subjoined claims.

In one illustrative use of the invention, a dry board surface is coated with a film of hardening liquid such as white primer paint which may be applied at a rate of 25 – 30 grams per square foot. A granular texture material such as 10 – 40 U.S. standard mesh silica blast sand, glass beads, perlite, vermiculite, rock wool shot, roofing granules, ground walnut shells, wood chips, chopped wire, or mixtures thereof is then evenly distributed upon the wet painted surface of the board at the rate of 40–45 grams per square foot, when employing No. 20 white sand sold by Ottawa Silicate Co. for example. Subsequently, a second coat of white primer paint is applied at a rate of 25 – 30 grams per square foot to cover the texturing material. White sand designated No. 20 by Ottawa Silicate Co. comprises particles from 15 – 35 percent 20 mesh size, from 40 – 55 percent 30 mesh size, from 15 – 30 percent 50 mesh size and from 0 – 10 percent greater than 16 mesh size. Number 45 white sand sold by Ottawa Silicate Co. and comprising particles from 65 – 90 percent 50 mesh size, from 10 – 20 percent 60 mesh size, from 0 – 5 percent 30 mesh size and from 0 – 5 percent greater than 16 mesh size can also be used. The dried granular textured surface is then supported upon the lower platen of an embossing press while an upper platen of the press carrying an embossing plate is brought into engagement with the exterior surface of the panel to shear artificial openings into the panel extending from the exterior surface and penetrating substantially into the body of the unit. In this manner or through such other procedures as cold roll embossing, routing, etching, or die-stamping, a pattern of random indentations, contours, projections, or combinations of these may be obtained on the panel's exterior surface.

Roughened ceiling tile constructed in accordance with the foregoing method for use in modular building units can be installed face upward upon ceiling trusses or joists 52 arranged with a vapor barrier in the conventional way. Long edges 54 of the panels 10 are then located parallel with joists 52 so that joints 56 are centered on joists 52. Although joints 56 are shown in FIG. 2, FIG. 3, and FIG. 4 for illustrative purposes they generally do not detract from the monolithic effect of panels applied in accordance with the invention. With panel 10 laid in proper position on furring strips, trusses or joists, and temporarily held in one place by the applicator, fasteners 20 are randomly inserted into panels 10 along joists 52, furring strips 12 or intermediate framing members 58 by rotating staple gun 60 or other pneumatic or electrically driven tool sufficiently to prevent parallel alignment of adjacent indentations. The textured granular coated surface affords such excellent scuff and impact resistance that workmen can walk freely over the panel during the stapling operation without tarnishing the exterior surface thereof.

As will be readily understood, it is essential that fastener 20 enter panel 10 with a force sufficient to drive crown 22 into firm contact with material at the bottom of indentation 16 so that pointed end 30 of shank 32 passes through the material at the base of indentation 16 and into joist 52. The readily compressible and destructible panel material will result in decreased holding power if the fastener is driven too far. Since the invention operates to interpose a thickness of board material between crown 22 of fastener 20 and furring strip 12 which is greater than if the staple were driven into contact with the bottom of a pre-existing fissure, a stronger bond is engendered which enables deeper indentation of fastener 20 to achieve for a fire, scuff and impact resistant panel secured by concealed fasteners, (1) considerably greater surface roughness than ordinarily attained by relatively thin panels, (2) an installation of panels thinner than heretofore applied, and (3) more rapid erection of textural panels with minimum risks of injury to the surface thereof.

Referring to FIGS. 10 and 11, the appearance of a portion of a decorative panel is illustrated. FIG. 10 shows a decorative panel 10 with surface 42 of granular textured construction containing indentations 14 which has not yet been secured to a supporting structure by entry of mechanical fasteners 20. Each dotted portion 62 on textural surface 42 connotes an area appointed for entry of fastener 20. Note that in FIG. 5 crowns 22 of fasteners 20 do not bottom on pre-selected low areas 15 of indentations 14, but create additional indentations 16 upon entering panel surface 42. These new indentations 16 are of the same shape, color and appearance as indentations 14. An overall similarity of configurations between indentations 14 and 16 masks the appearance of mechanical fasteners driven to firm contact with material at the bottom of perforations effected in the granular coated exterior surface by their entry. The invention additionally permits a stronger bond to be generated between panel and supporting structure in far shorter time, with greater ease and at less expense than ere now feasible for panels in which the fasteners are concealed without the use of auxiliary devices such as surface mounted rosettes, for example. As illustrated in FIGS. 10 and 11, the dramatic results achieved by our unique invention have virtually eliminated the appearance of unattractive surface mounted fasteners, cracks, and nail pops. The mechanical fasteners become lost among textured lower and higher portions of the panel's exterior surface to produce an aesthetic effect restfully pleasing to the eye. In addition, a low cost fire resistant surface is created which permits rapid erection upon a wide variety of supporting structures with minimum risk of injury to the panels. Since panel-support relationships and construction techniques previously thought inappropriate are now practical, a desirable coupling of panels having surfaces sufficiently shaped to be compatible with the above noted contemporary aesthetic and economic requirements can be achieved.

It will be apparent to those versed in the science of panel construction that the similarity of appearance produced between indentations 14 and 16 by this invention may exist for surfaces textured by indentations having a variety of configurations depending upon the fastening means which are used and the aesthetic effect desired. Where appropriate, during installation of unidirectional indentations, ridges or contours more regular in appearance, the fastener may be inserted relative to other perforations on the textural surface to continue a regularly spaced series of indentations, extend a ridge, or touch up a contour. Instead of the more rectangularly shaped indentations shown by the panel of FIG. 1 for example, a plurality of randomly located indentations such as illustrated in FIG. 9 can be used in combination with mechanical fasteners having a rounded crown which corresponds in shape and size with the configuration of the pre-existing indentations. Subsidiary advantage may also be realized from the scuff and impact withstanding textural surface. Textural peaks formed by the natural or synthetic granular coating produce a highly scuff and impact resistant surface which can be walked on during industrial constructin of the panels without smudge damage. Inasmucn as the electrical or pneumatic tool employed to impel fasteners into the panels is manipulated entirely by one hand, the other hand is left free during home installations to hold the panel in place while the initial fastener is implanted. As illustrated by FIG. 4 panel 10 can be secured to furring strips 12 and applied as shown in FIG. 3 for use within the home. The resulting monolithic surface can be washed or touched up without injury, while resistance to sag and vapor transmission enable the panel's application in increased dimensional sizes to supporting structures of varying frame spacings up to 16 inches on center within humid environments.

Since certain changes may be made in our novel textural panel without departing from the scope of the invention herein involved, it is intended that all matters contained in the above description or shown in the accompanying drawings shall be interpreted as illustrative and not in a limiting sense.

What I claim is:

1. A process of forming a visible textural surface on a decorative acoustical panel having a fibrous body portion comprising:

a. coating an exterior surface of the body with a film of hardening liquid;

b. distributing individual granules of particulate material generally uniformly over a substantial portion of the coated exterior surface to provide a granular texture to said surface;

c. coating the granules with a film of hardening liquid adhering the granules to the exterior surface, said film being insufficient to eliminate said granular texture; and d. thereafter indenting part of the surface on which the liquid coated granules are located, said indentations extending from the exterior surface penetrating part way into the panel body to cause displacement of said part of said surface thereby forming portions of walls, said walls including some of said coated granules, said coated granules on said exterior surface and on said walls of said indentations comprising a part of said visible textural surface of said panel.

* * * * *